United States Patent [19]

Kudo et al.

[11] Patent Number: 4,990,073

[45] Date of Patent: Feb. 5, 1991

[54] TWO-CYLINDER ROTARY COMPRESSOR HAVING IMPROVED VALVE COVER STRUCTURE

[75] Inventors: Motohiro Kudo; Yasuhiro Tsuchiya, both of Numazu, Japan

[73] Assignee: Kabushiki Kaisha Toshiba, Kawasaki, Japan

[21] Appl. No.: 427,472

[22] Filed: Oct. 27, 1989

[30] Foreign Application Priority Data

Oct. 31, 1988 [JP] Japan ..... 63-142052[U]

[51] Int. Cl.[5] ..... F04C 29/06; F04C 23/00

[52] U.S. Cl. ..... 418/60; 418/181; 181/272; 181/403

[58] Field of Search ..... 418/181, 60; 181/403, 181/272, 240

[56] References Cited

FOREIGN PATENT DOCUMENTS

| | | | |
|---|---|---|---|
| 0222109 | 5/1987 | European Pat. Off. . | |
| 53-111512 | 9/1978 | Japan . | |
| 220991 | 12/1983 | Japan | 418/60 |
| 128990 | 12/1985 | Japan | 418/60 |
| 210286 | 9/1986 | Japan | 418/181 |
| 62-133987 | 8/1987 | Japan . | |
| 235688 | 9/1988 | Japan | 418/60 |

*Primary Examiner*—John J. Vrablik
*Assistant Examiner*—David L. Cavanaugh
*Attorney, Agent, or Firm*—Cushman, Darby & Cushman

[57] ABSTRACT

A sealed case has first and second housing portions. A motor section is arranged in the first housing portion of the sealed case and has a rotating shaft extending toward the second housing portion. A compression section has first and second compression mechanisms stacked in the second housing portion of the sealed case and driven by the rotating shaft. A first valve cover has a predetermined volume so as to temporarily store a high-pressure fluid discharged from the first compression mechanism near the motor section. A second valve cover has a predetermined volume larger than that of the first valve cover so as to temporarily store a high-pressure fluid discharged from the second compression mechanism opposite to the motor section.

8 Claims, 5 Drawing Sheets

TWO-CYLINDER ROTARY COMPRESSOR HAVING IMPROVED VALVE COVER STRUCTURE

BACKGROUND OF THE INVENTION

1. Field of the Invention

The present invention generally relates to a rotary compressor and, more particularly, to an improvement in the valve cover structure of a compressor having two compression mechanisms in a sealed case.

2. Description of the Related Art

As is known, various types of compressors have been used for, e.g., refrigerators, air conditioners, and the like. A so-called two-cylinder rotary compressor is known as one of these conventional compressors. In this compressor, two rotary type compression mechanisms are incorporated in a sealed case.

According to the above rotary compressor, a motor section is arranged in the upper portion of the sealed case, and a compression mechanism section (to be described later) is arranged in the lower portion.

In the compression mechanism section, a pair of compression mechanisms are constituted by a pair of cylinders each having one end face joined to a corresponding side surface of a partition plate (spacer), a pair of rotors rotatably housed in the respective cylinders and eccentrically rotated by a crankshaft, a pair of bearings joined to the other end faces of the cylinders, a pair of discharge valves respectively arranged in the bearings, and a pair of valve covers arranged to cover the discharge valves.

The crankshaft as a rotating shaft of the motor section is coupled to the rotors. Therefore, if the motor section is operated, the respective rotors are eccentrically rotated by the crankshaft. With this operation, a gaseous refrigerant is drawn into the cylinders of the compression mechanisms by suction and compressed by the rotors. The compressed gaseous refrigerant forcibly opens each discharge valve and is discharged into each valve cover.

The gaseous refrigerant discharged into one valve cover located on the motor section side flows into the sealed case through a first path formed between the valve cover and the bearing. The gaseous refrigerant discharged into the other valve cover flows into the sealed case through a second path extending between the respective bearings joined to the pair of cylinders. With this arrangement, the gaseous refrigerant flowing into the closed case from one valve cover on the motor section side flows more easily than the gaseous refrigerant flowing into the sealed case from the other valve cover on the counter-motor section side.

In such a conventional compressor, the volume of one cover located on the motor section side is set to be substantially equal to or larger than that of the other valve cover. For this reason, the pressure of a gaseous refrigerant to be discharged into the other valve cover inevitably becomes larger than that of a gaseous refrigerant to be discharged into the first valve cover. As a result, the super compression of the other compression mechanism may be increased, or the overall compression efficiency of the compressor may be decreased because of the unbalanced compression efficiency of the pair of compression mechanisms.

In addition, if the super compression of the compression mechanism on the counter-motor section side is increased, the discharge timings of the pair of compression mechanisms may be unbalanced, resulting in degradation in noise characteristics.

As described above, in the conventional two-cylinder rotary compressor, since the volume of the valve cover on the counter-motor section side, from which a gaseous refrigerant does not easily flow into the sealed case, is substantially equal to or smaller than that of the valve cover on the motor section side, the super compression of the compression mechanism on the counter-motor section side becomes larger than that of the compression mechanism on the motor section side, resulting in a decrease in compression efficiency or degradation in noise characteristics.

SUMMARY OF THE INVENTION

It is, therefore, an object of the present invention to provide a new and improved two-cylinder rotary compressor which can increase the overall compression efficiency of the compressor and can effectively reduce the noise level by suppressing the super compression of the compression mechanism on the counter-motor section side to the same level as that of the super compression of the compression mechanism on the motor section side.

According to the present invention, there is provided a rotary compressor comprising:

- a sealed case having first and second housing portions therein;
- a motor section arranged in the first housing portion of the sealed case and having a rotating shaft extending toward the second housing portion;
- a compression section having first and second compression mechanisms stacked in the second housing portion of the sealed case and driven by the rotating shaft;
- a first valve cover having a predetermined volume so as to temporarily store a high-pressure fluid discharged from the first compression mechanism near the motor section; and
- a second valve cover having a predetermined volume larger than that of the first valve cover so as to temporarily store a high-pressure fluid discharged from the second compression mechanism opposite to the motor section.

Additional objects and advantages of the invention will be set forth in the description which follows, and in part will be obvious from the description, or may be learned by practice of the invention. The objects and advantages of the invention may be realized and obtained by means of the instrumentalities and combinations specifically pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

An embodiment of the present invention will be described below with reference to FIGS. 1 to 4. The compressor shown in FIG. 2 has a sealed case 1. A compression section 2 and a motor section 4 for rotating a crankshaft 3 are housed in the sealed case 1.

Figure 1:
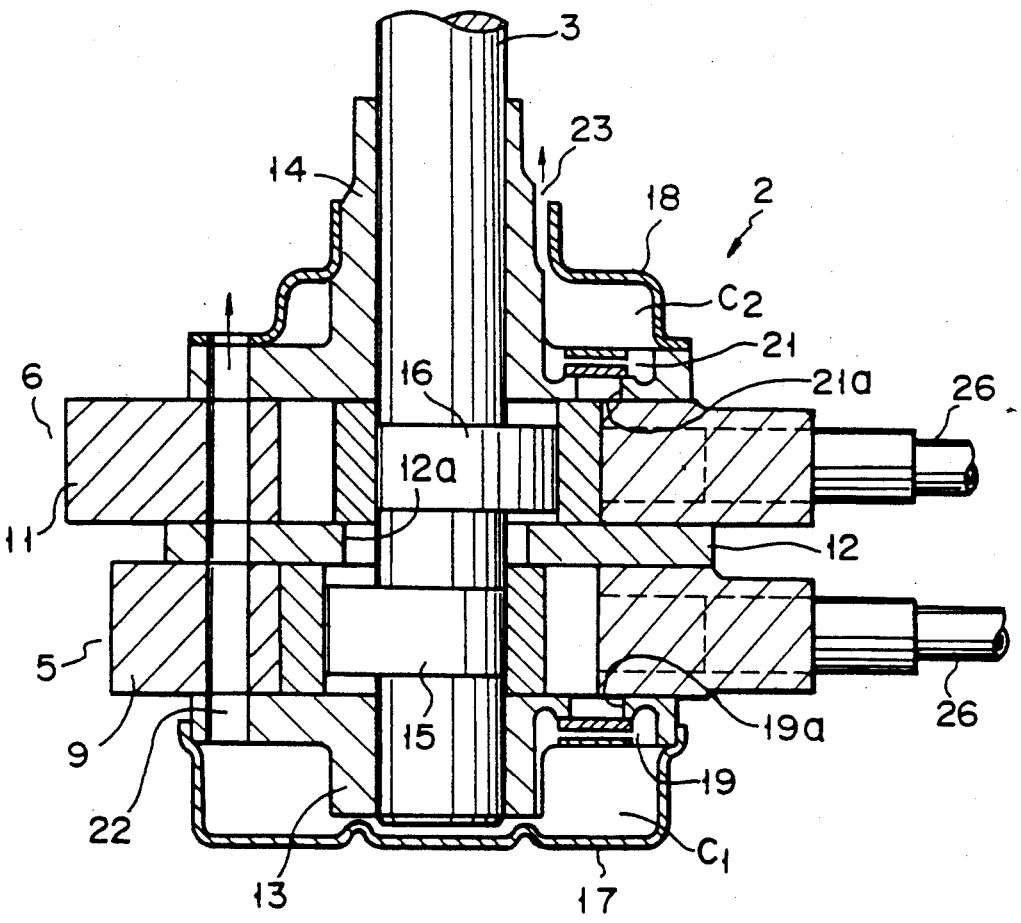
FIG. 1 is a partially enlarged sectional view showing a pair of compression mechanisms according to an embodiment of the present invention.
Figure 2:
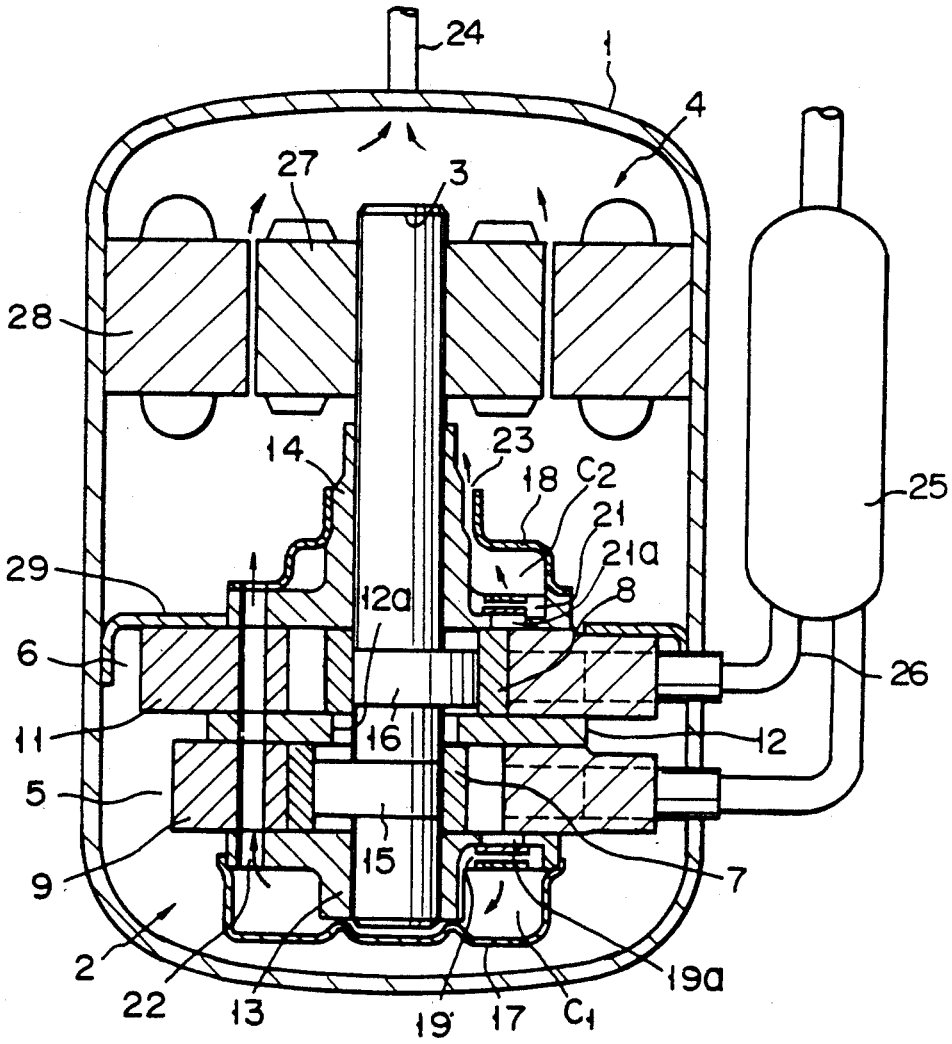
FIG. 2 is a longitudinal sectional view of an overall compressor according to the embodiment.

The compression section 2 comprises a first compression mechanism 5 located on the lower side (counter-motor section 4 side) in FIG. 2, and a second compression mechanism 6 located on the upper side (motor section 4 side). The compression mechanisms 5 and 6 respectively have cylinders 9 and 11 in which rotors 7 and 8 are rotatably housed. One end of each of the cylinders 9 and 11 is joined to a corresponding side surface of a partition plate (spacer) 12. A through hole 12*a* is formed in the partition plate 12 so as to receive the crankshaft 3. A sub-bearing 13 is joined/fixed to the other end face of the cylinder 9 of the first compression mechanism 5 located on the lower side. A main bearing 14 is joined/fixed to the other end face of the cylinder 11 of the second compression mechanism 6.

The lower end portion of the crankshaft 3 is rotatably supported by the sub-bearing 13, and the intermediate portion of the crankshaft 3 is similarly rotatably supported by the main bearing 14. First and second crankshaft portions 15 and 16 are arranged at a portion of the crankshaft 3 between the sub-bearing 13 and the main bearing 14. The first and second crankshaft portions 15 and 16 are rotatably fitted in the rotors 7 and 8, respectively.

The sub-bearing 13 is covered with a first valve cover 17. The main bearing 14 is covered with a second valve cover 18. The volume C1 of the first valve cover 17 is set to be larger than the volume C2 of the second valve cover 18.

Discharge holes 19*a* and 21*a* respectively communicating with the interiors of the cylinders 9 and 11 are formed in portions of the bearings 13 and 14 which are respectively covered with the valve covers 17 and 18. Discharge valves 19 and 21 are respectively arranged in the discharge holes 19*a* and 21*a*. A gaseous refrigerant which is a fluid compressed by each of the rotors 7 and 8 of the compression mechanisms 5 and 6 forcibly opens the discharge valves 19 and 21 and is discharged therefrom into the valve covers 17 and 18, respectively.

The gaseous refrigerant which is discharged and temporarily stored in the first valve cover 17 flows into the sealed case 1 through a first path 22 extending through the sub-bearing 13 and the main bearing 14. The gaseous refrigerant which is discharged and temporarily stored in the second valve cover 18 flows into the sealed case 1 through a second path 23 between the cover 18 and the outer surface of the main bearing 14. The flow resistances of the first and second paths 22 and 23 are set such that the gaseous refrigerant portions respectively discharged in the first and second valve covers 17 and 18 flow into the sealed case 1 with substantially the same flow resistance. More specifically, the sectional area of the first path 22 is set to be sufficiently larger than that of the second path 23 so as to allow the gaseous refrigerant discharged into the first valve cover 17 to flow out at substantially the same flow rate per unit time as that of the gaseous refrigerant discharged into the second valve cover 18.

The gaseous refrigerant flowing into the sealed case 1 from the paths 22 and 23 flows outside the case 1 through a discharge pipe 24 connected to the upper portion of the case 1.

Note that suction pipes 26 are respectively connected to the pair of cylinders 9 and 11 through a suction cup (accumulator) 25.

The upper end portion of the crankshaft 3 extending from the main bearing 14 is fitted/fixed, as the rotating shaft of the motor section 4, in a rotor 27 of the motor section 4. The rotor 27 is rotatably inserted in a stator 28. With this structure, if the rotor 27 is rotated, the crankshaft (motor rotating shaft) 3 is rotated, and the rotors 7 and 8 are eccentrically rotated by the crankshaft portions 15 and 16, respectively. As a result, a compressed gaseous refrigerant is discharged from the discharge pipe 24.

Note that reference numeral 29 in FIG. 2 denotes a mounting plate for fixing the compression section 2 to the sealed case 1 through the second compression mechanism 6.

Figure 3:
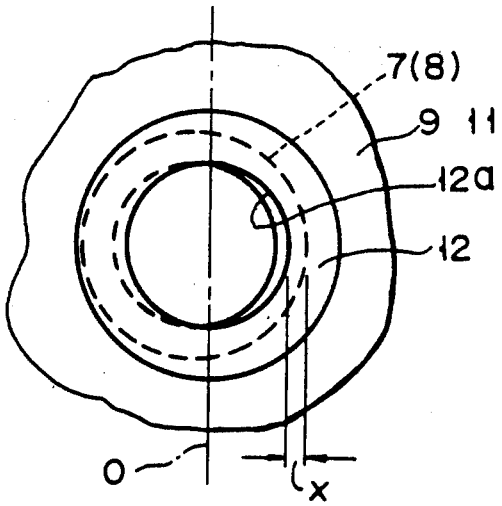
FIG. 3 is a plan view showing a relationship between a through hole formed in a partition plate and each cylinder according to the embodiment.

The inner diameter of the through hole 12*a* which is formed in the partition plate 12 so as to receive the crankshaft 3 is eccentrically set with respect to the inner diameters of the cylinders 9 and 11, as shown in FIG. 3. More specifically, the through hole 12*a* is shifted from a center line O to the left, i.e., to the counter-high-pressure portion. With this arrangement, as indicated by reference symbol x in FIG. 3, the minimum tight width defined between the through hole 12*a* and each of the rotors 7 and 8 can be sufficiently increased as compared with the case wherein the through hole 12*a* is formed to be concentric with the cylinders 9 and 11. As a result, airtightness between the compressed spaces in the cylinders 9 and 11 and the space around the crankshaft portions is improved, and hence the coefficient of performance $$COP = \frac{\text{(refrigeration capability)}}{\text{motor input}} \quad )$$

of the compressor can be increased.

According to the compressor having the above-described arrangement, since the volume C1 of the valve cover 17 of the first compression mechanism 5 on the counter-motor section 4 side is set to be sufficiently larger than the volume V2 of the valve cover 18 of the second compression mechanism 6 on the motor section 4 side, the super compression of the first compression mechanism 5 and pulsation of the pressure of a gaseous refrigerant discharged into the first valve cover 17 is greatly reduced to become substantially the same as that of the super compression of the second compression mechanism 6 and a gaseous refrigerant discharged into the second valve cover 18.

Figure 4A:
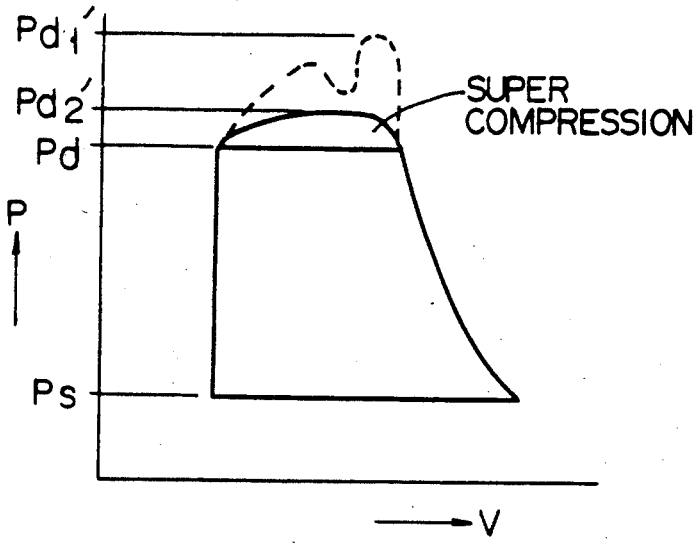
FIGS. 4A and 4B are P–V graphs respectively showing states of super compression of a conventional compressor and the compressor of the present invention.
Figure 4B:
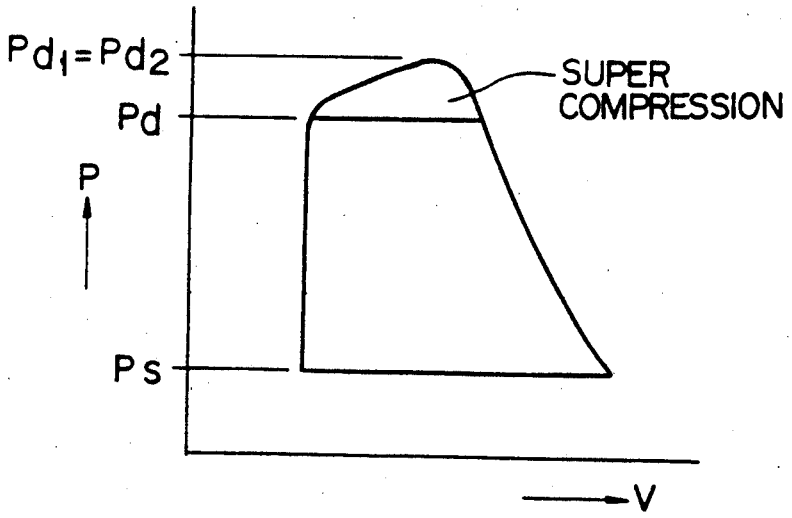

FIGS. 4A and 4B show this state. FIGS. 4A and 4B are P–V graphs of the conventional compressor and the compressor of the present invention. Ps as shown in FIG. 4A, is suction pressure of the compressor. In the conventional compressor, the super compression of the first compression mechanism 5, on the counter-motor section 4 side as indicated by a broken line FIG. 4A, becomes larger than that of the second compression mechanism 6 on the motor section 4 side as indicated by a solid line in FIG. 4A, and moreover the pulsation is significant.

In contrast to this, in the present invention, the super compressions of the first and second compression mechanisms 5 and 6 are substantially the the same as indicated by a solid line in FIG. 4B, and almost no pulsation occurs in the first valve cover 17.

Consequently, the compression efficiency of the compressor of the present invention can be increased as compared with the conventional compressor. In addition, the flow resistances of the paths from the valve covers 17 and 18 to the sealed case 1, through which a gaseous refrigerant flows, are set to be substantially the same. This also serves to set the super compressions of the first and second compression mechanisms 5 and 6 to be almost equal to each other.

In FIGS. 4A and 4B, each compression efficiency can be obtained as follows:

$$\text{compression efficiency} = \frac{(\text{total area}) - (\text{area of super compression})}{(\text{total area including area of super compression})}$$

It is apparent, therefore, that the compression efficiency of the conventional compressor having a larger area of super compression is smaller than that of the compressor of the present invention. Note that in FIGS. 4A and 4B, reference symbol Pd represents the pressure in each sealed case; Pd1 and Pd1', the pressures at which the discharge valves in the cylinders of the first compression mechanisms respectively open; and Pd2 and Pd2', the pressures at which the discharge valves in the cylinders of the second compression mechanisms respectively open.

Figure 5:
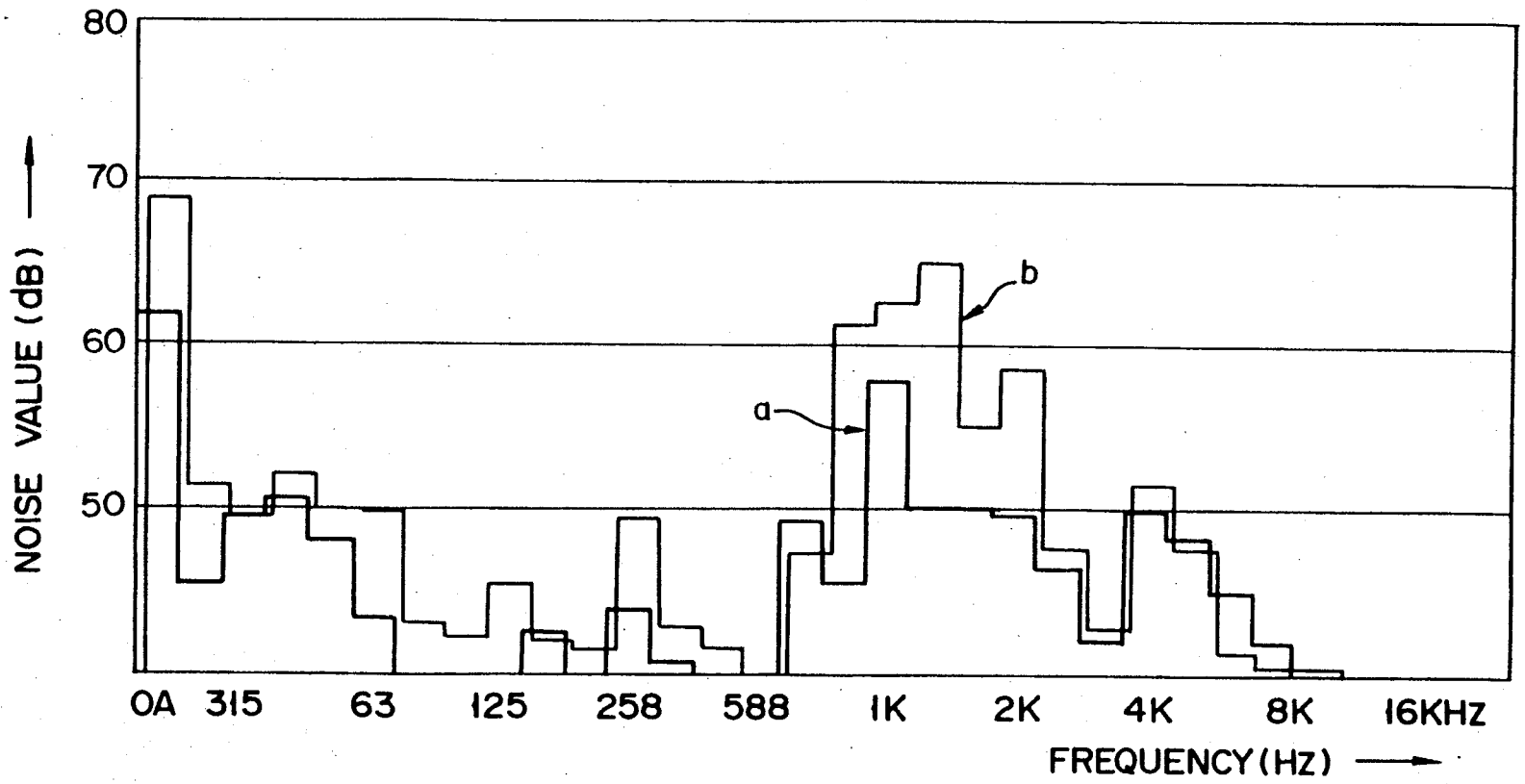
FIG. 5 is a graph showing measurement results of noise of the conventional compressor and the compressor of the present invention.

FIG. 5 is a graph showing a noise comparison ($\frac{1}{3}$ octave analysis) of the compressor of the present invention and the conventional compressor when they are operated at 60 Hz. In FIG. 5, the horizontal axis gives frequency (Hz), the vertical axis gives noise value (dB) and, line a represents the noise level of the compressor of the present invention, and line b represents the noise level of the conventional compressor. As is apparent from FIG. 5, the noise level of the compressor of the present invention is greatly reduced as compared with the conventional compressor.

Note that the compressors were operated under the ASHRAE standard conditions (condenser temperature 54.4° C., evaporator temperature 7.2° C., suction temperature 35° C., and super cooled temperature 8.3° C.) as measurement conditions, and pressure levels were measured at a predetermined distance from each compressor. In the conventional compressor, if the volume of the first valve cover is assumed to be 100, the volume of the second valve cover is 147. In the compressor of the present invention, if the volume of the first valve cover is assumed to be 100, the volume of the second valve cover is 76.

Figure 6:
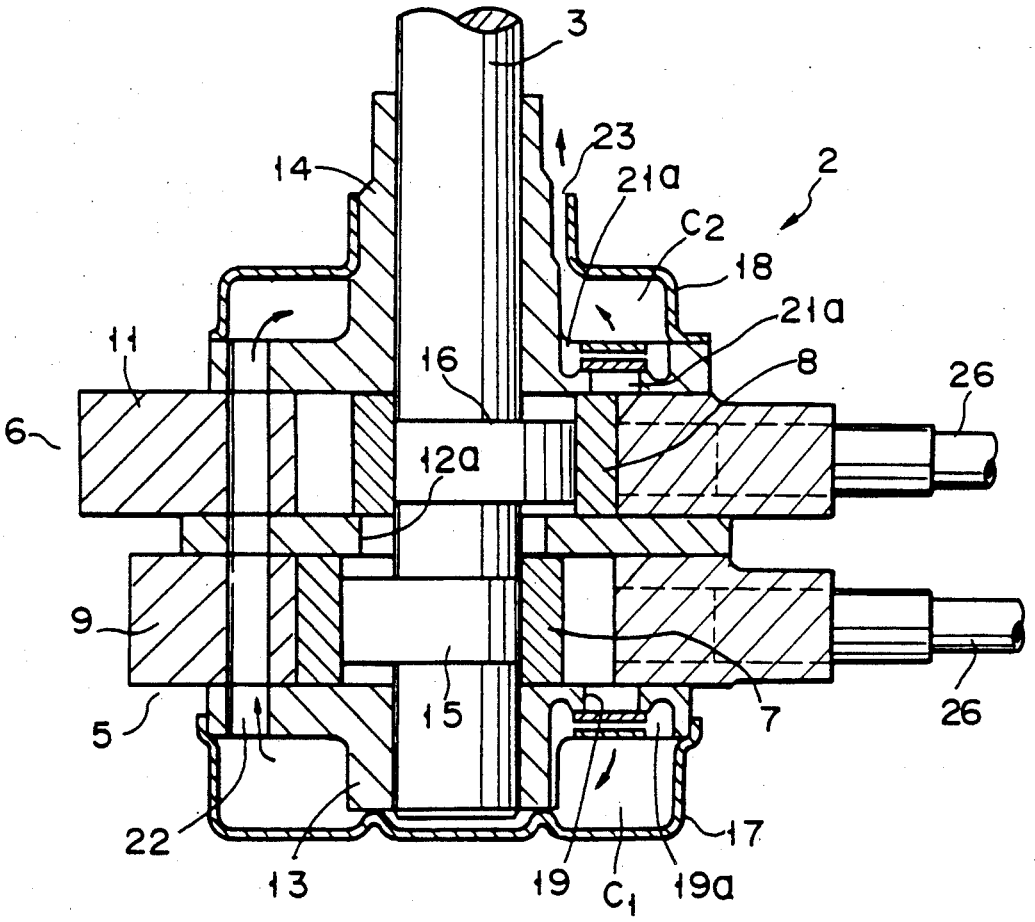
FIG. 6 is a partially enlarged sectional view showing compression mechanisms according to another embodiment of the present invention.

FIG. 6 shows another embodiment of the present invention. According to a compressor of this embodiment, a first path 22 extending through a sub-bearing 13 and a main bearing 14 has one end communicating with the interior of a first valve cover 17 and the other end communicating with the interior of a second valve cover 18. With this structure, a gaseous refrigerant discharged from the first compression mechanism 5 flows from the second valve cover 18 into the sealed case 1 through a second path 23 together with a gaseous refrigerant discharged from the second compression mechanism 6.

Similar to the first embodiment, the volume C1 of the first valve cover 17 is set to be larger than the volume C2 of the second valve cover 18.

Similarly, with this arrangement, the internal pressures of the first and second valve covers 17 and 18 can be set to be substantially the same. In addition, since pulsation does not easily occur in each valve cover, super compression can be reduced, and the operating efficiency of the compressor can be improved.

As has been described above, according to the present invention, the volume of the valve cover of the compression mechanism on the counter-motor section side is set to be larger than that of the valve cover of the compression mechanism on the motor section side. Therefore, since the super compression of the compression mechanism on the counter-motor section side can be reduced as compared to the conventional compressor, the overall operating efficiency of the compressor can be improved, and the noise level can be decreased.

What is claimed is:

1. A rotary compressor comprising:

a sealed case having first and second housing portions therein;

a motor section arranged in said first housing portion of said sealed case and having a rotating shaft extending toward said second housing portion;

a compression section having first and second compression mechanisms stacked in said second housing portion of the said sealed case and driven by said rotating shaft;

a first valve cover; and a second valve cover, said second valve cover having a predetermined volume so as to temporarily store a high-pressure fluid discharged from said second compression mechanism near said motor section, said first valve cover having a predetermined volume larger than that of said second valve cover so as to temporarily store a high-pressure fluid discharged from said first compression mechanism opposite said motor section;

wherein said first valve cover communicates with said sealed case through a first path, and said second valve cover communicates with said sealed case through a second path, said second path being formed along said rotating shaft, a sectional area of said first path being set to be a sufficient value larger than a sectional area of said second path for causing a high-pressure fluid to flow at substantially the same flow rate per unit time as that of the high-pressure fluid flowing in said second path, the volume of said first valve cover and the sectional area of said first path being selected to adjust the super compression of said first compression mechanism to a level substantially equal to that of the super compression of said second compression mechanism, said first ad second compression mechanisms including a pair of cylinders coupled to each other respectively through spacer means, and a pair of rotors respectively arranged in said cylinders so as to be eccentrically rotatable, said first path being formed to extend through said pair of cylinders and said spacer means.

2. A compressor according to claim 1, wherein the high-pressure fluid includes a gaseous refrigerant.

3. A compressor according to claim 1, wherein flow resistances of said first and second paths with respect to the high-pressure fluid are set to be substantially the same.

4. A compressor according to claim 1, wherein said first path communicates at an end thereof with said second path.

5. A compressor according to claim 1, wherein said rotating shaft includes a crankshaft common to said first and second compression mechanisms.

6. A compressor according to claim 1, wherein said crankshaft is coupled to a rotor of said motor section.

7. A compressor according to claim 1, wherein, assuming that the volume of said first valve cover is 100, the volume of said second valve cover is selected to be about 76.

8. A compressor according to claim 1, wherein each of said first and second compression mechanisms draws, by suction, a fluid to be compressed from accumulator means so as to compress/discharge the fluid.

* * * * *